US007059381B2

(12) United States Patent
Chen

(10) Patent No.: US 7,059,381 B2
(45) Date of Patent: Jun. 13, 2006

(54) CURVED WINDOW BLIND

(76) Inventor: Ching-Piao Chen, Row 2D Yin San Industrial Zone, Qing Xi Town, Dong Guan, Guang Don (CN)

( * ) Notice: Subject to any disclaimer, the term of this patent is extended or adjusted under 35 U.S.C. 154(b) by 0 days.

(21) Appl. No.: 10/987,644

(22) Filed: Nov. 15, 2004

(65) Prior Publication Data

US 2005/0284587 A1 Dec. 29, 2005

(30) Foreign Application Priority Data

Jun. 25, 2004 (CN) ..... 2004 2 0070831

(51) Int. Cl.
*E06B 9/386* (2006.01)

(52) U.S. Cl. ..... 160/236; 160/DIG. 7

(58) Field of Classification Search ..... 160/231.1, 160/231.2, 236, 237, 243, DIG. 7; 139/383 R, 139/386

See application file for complete search history.

(56) References Cited

U.S. PATENT DOCUMENTS

| | | | | | |
|---|---|---|---|---|---|
| 1,810,899 | A * | 6/1931 | Boehm | 160/88 |
| 2,244,300 | A * | 6/1941 | Kwon | 160/196.1 |
| 2,724,434 | A * | 11/1955 | Smith | 160/348 |
| 4,773,958 | A * | 9/1988 | Goodman | 156/313 |
| 4,842,036 | A * | 6/1989 | Goodman | 160/166.1 |
| 6,276,429 | B1 * | 8/2001 | Chen | 160/231.1 |
| 6,378,567 | B1 * | 4/2002 | Chen | 139/383 R |
| 6,622,763 | B1 * | 9/2003 | Chen | 144/350 |
| 6,880,611 | B1 * | 4/2005 | Nien | 160/236 |
| 2005/0167057 | A1 * | 8/2005 | Nien | 160/236 |

* cited by examiner

*Primary Examiner*—David Purol
(74) *Attorney, Agent, or Firm*—David W. Wong

(57) ABSTRACT

A flexible curved window is made by arranging a plurality of fine size elongated rods in a parallel manner. A plurality of strings interlaced between alternate ones of the rods to form a matt-like base structure and a flexible liquid absorbent sheet material wetted with adhesive is applied over the surface of the matt-like base structure and then trimmed to fit the size of the latter. When the adhesive is dried and set the contraction of the sheet material causes the blind to curve towards the surface having the sheet material.

7 Claims, 2 Drawing Sheets

CURVED WINDOW BLIND

FIELD OF INVENTION

This invention relates to a window blind and more particularly a curved multi-slat window blind which may be readily rolled in the open condition.

BACKGROUND OF THE INVENTION

Multi-slat window blinds consist of a plurality of slats linked together with cords and they are convenient to use. Such window blinds enhance the pleasant decorative appearance of windows to which they are mounted. Presently there two main types of multi-slat window blinds, namely one type in which the horizontal slats are drawn in a stacking manner vertically up or down to open or to cover over the window; while in the second type the blind may be opened by scrolling it vertically into a roll. Since the slats are commonly made of generally flat plastic plates, the scroll is rather bulky in size due to the spaces between the juxtaposed plates such that it is difficult to form a tight compact roll.

It has also been the trend that people prefer to use natural material for decoration of their homes in order to provide a natural antique appearance as well as a more healthy environment.

SUMMARY OF THE INVENTION

It is the principal object of the present invention to provide a curved window blind made made of natural material.

It is another object of the present invention to provide a window blind having a plurality of elongated rods linked together with a plurality of cords and additionally adhered together with a sheet material applied on its surface.

It is another object of the present invention to provide a window blind which may be scrolled into a compact roll.

It is yet another object of the present invention to provide a window blind having an antique natural decorative appearance and providing a healthy environment.

It is still another object of the present invention to provide a window blind which may be fabricated easily with very low cost.

DETAILED DESCRIPTION OF THE PREFERRED EMBODIMENTS

Figure 1:
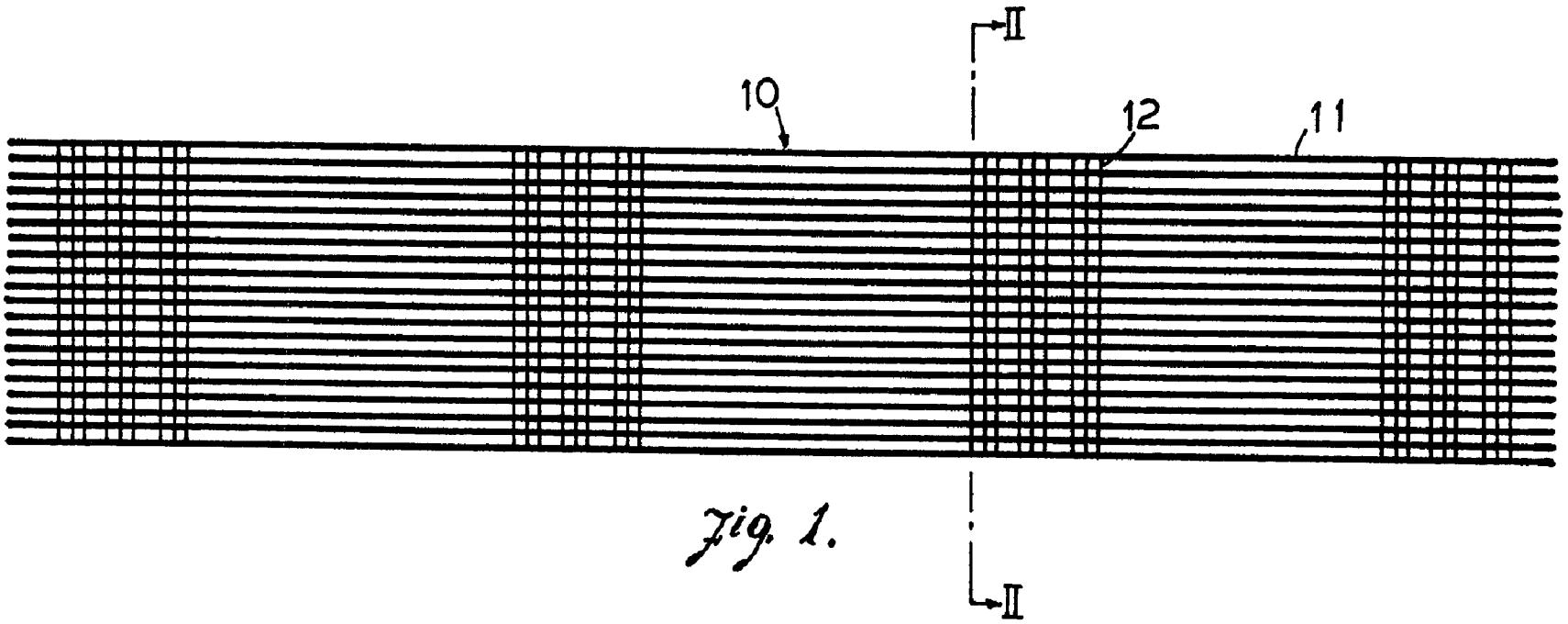
FIG. 1 is a front perspective elevation view of the window blind according to the present invention.
Figure 2:
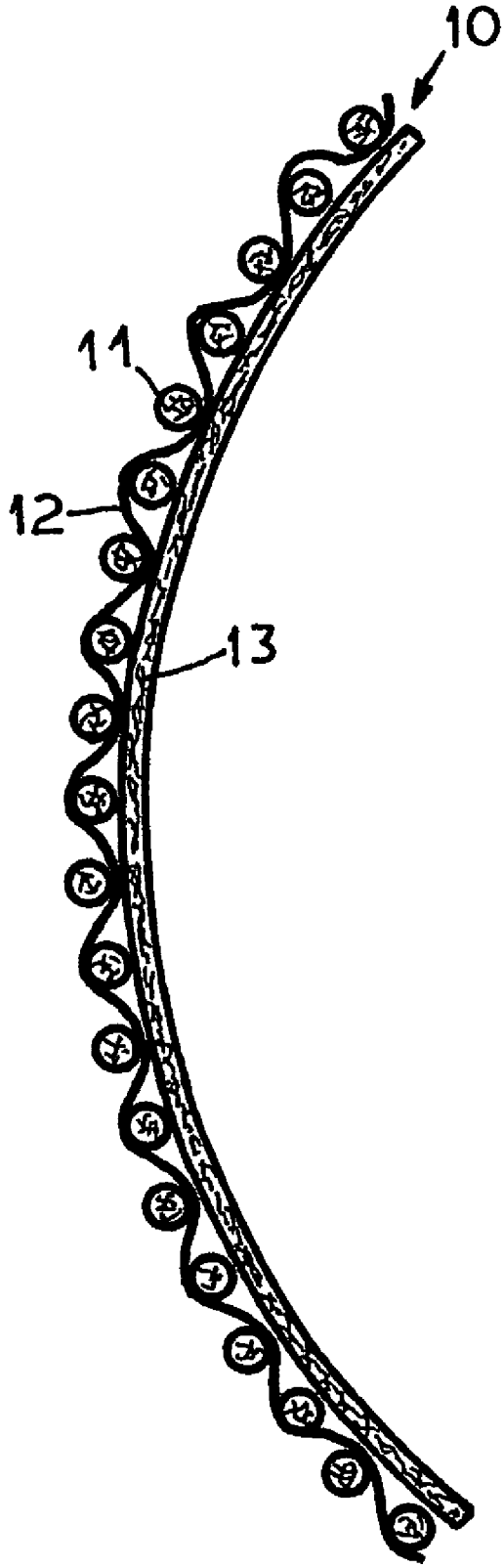
FIG. 2 is an enlarged sectional side elevation view along sectional line II—II of FIG. 1 showing the curvature of the window blind according to the present invention.

With reference to the drawings in which like reference numerals designate corresponding parts in the two difference views, the window blind 10 has a plurality of elongated round rods 11 arranged in a parallel manner. Small bamboo sticks having a fine size may be used for such purposes to provide the natural appearance of the blind; furthermore, ham strings may be placed between the bamboo sticks to enhance its natural antique appearance and color. A plurality of cords 12 are interlaced between alternate rods 11, as best shown in FIG. 2, to form a matt-like base structure of the blind. For simplicity of illustration, four groups of nine cords 12 are shown in FIG. 1. A sheet material 13 such as flexible and liquid absorbent paper or cloth is wetted with liquid adhesive and then applied over one surface of the matt-like base. The cords 12 and the sheet material 13 as well as the adhesive cooperate to maintain the fixed structure of the entire window blind 10. The paper or cloth has a high flexibility and when it still moist with adhesive it is trimmed to conform with the size of the matt-like base structure. The moist sheet material 13 will naturally contract in size when the adhesive has dried and set. The contraction of the sheet material 13 will inherently cause the blind to assume the desirable curvature as best shown in FIG. 2.

A selective pattern may be formed by the interlaced cords 12 and an aesthetic pattern or picture may also be painted over the sheet material 13 to enhance the appearance of the blind.

The blind may be easily scrolled into a very compact roll due to its flexibility and the small size of the rods 11, and the blind may be easily fabricated with very cost. Green bamboo sticks may be used to provide a desirable natural appearance for the blind. Since all natural materials are used for making the blind of the present invention, it provides a healthy natural environment.

While the preferred embodiments of the invention have been described above. It will be recognized and understood that various modifications may be made therein and the appended claims are intended to cover all such modifications which may fall within the spirit and scope of the invention.

What is claimed is:

1. A curved window blind comprising:

a plurality of elongated rods arranged in a parallel manner, a plurality of cords wherein each cord is interlaced between alternate ones of said rods for forming a matt-like base structure with said rods, a flexible liquid absorbent sheet material affix to one entire surface of said matt-like base structure, said flexible liquid absorbent sheet material having been wetted with adhesive when applied over said one entire surface of said matt-like base structure whereby said blind has a permanent curvature upon drying and setting of said adhesive.

2. A curved window blind according to claim 1 wherein said rods are fine bamboo sticks.

3. A curved window blind according to claim 2 including a plurality of ham strings positioned between said bamboo sticks.

4. A curved window blind according to claim 1 wherein said flexible liquid absorbent sheet material is paper.

5. A curved window blind according to claim 4 wherein said cords form a decorative pattern in said matt-like base structure.

6. A curved window blind according to claim 4 including an aesthetic pattern and picture drawn selectively on said sheet material.

7. A curved window blind according to claim 1 wherein said flexible liquid absorbent sheet material is cloth.

* * * * *